United States Patent [19]

Dillinger

[11] 3,976,531

[45] Aug. 24, 1976

[54] MACHINE AND METHOD OF OPERATION THEREOF FOR PRODUCING NON-WOVEN "GLUED" CARPETS

[75] Inventor: Edward George Dillinger, Levittown, Pa.

[73] Assignee: Kemos, Incorporated, Marietta, Ga.

[22] Filed: Mar. 12, 1975

[21] Appl. No.: 557,747

[52] U.S. Cl. ..... 156/361; 156/435; 318/54; 318/65; 318/575

[51] Int. Cl.[2] ..... B65H 25/00

[58] Field of Search ..... 156/459, 474, 72, 350, 156/435, 436, 176; 112/2, 133–134; 318/8, 10, 575, 578, 54, 65, 162, 163, 256

[56] References Cited

UNITED STATES PATENTS

| | | | |
|---|---|---|---|
| 2,387,563 | 10/1945 | Chapple | 318/65 X |
| 2,459,253 | 1/1949 | Tyrner | 318/8 |
| 2,797,374 | 6/1957 | Atton et al. | 318/54 X |
| 2,827,105 | 3/1958 | Brundage | 318/9 X |
| 3,559,021 | 1/1971 | Bingham | 318/578 X |
| 3,657,052 | 4/1972 | Debonnet | 156/72 X |
| 3,915,789 | 10/1975 | Abel | 156/435 |

*Primary Examiner*—David A. Simmons

[57] ABSTRACT

The present invention is concerned with a machine for producing non-woven "glued" carpets and particularly with operating mechanism for alternately pressing a "pile-yarn" sheet against one and then the other of a pair of opposed adhesive-carrying backing layers or sheets between which the pile-forming fibrous materials or yarns are fed as in the form of a longitudinally advancing warp sheet moving concurrently with the backing sheets. After setting of the adhesive layers, which generally is effected during their concurrent advance, the intervening pile-forming sheet is cut to form two non-woven cut pile-surfaced carpets, in each of which the pile "yarns" project from the backing fabric or layer to which the pile is adhered. The present invention is particularly concerned with the mechanism for driving the presser bars, blades or plates alternately against opposite sides of the pile-forming sheet and thereby pressing the latter sheet against the adhesive-coated surface of the backing layer or sheet. The invention is also more particularly concerned with the control means and a manner of operating such means to provide an operating system that is characterized by high versatility in respect to the variety of carpets that may be produced, e.g., cut-pile, looped-pile, pile heights, etc. Hereinafter, the "pile-forming" fibrous sheet may be termed simply "fibrous sheet" or "warp sheet."

11 Claims, 5 Drawing Figures

Figure 5:
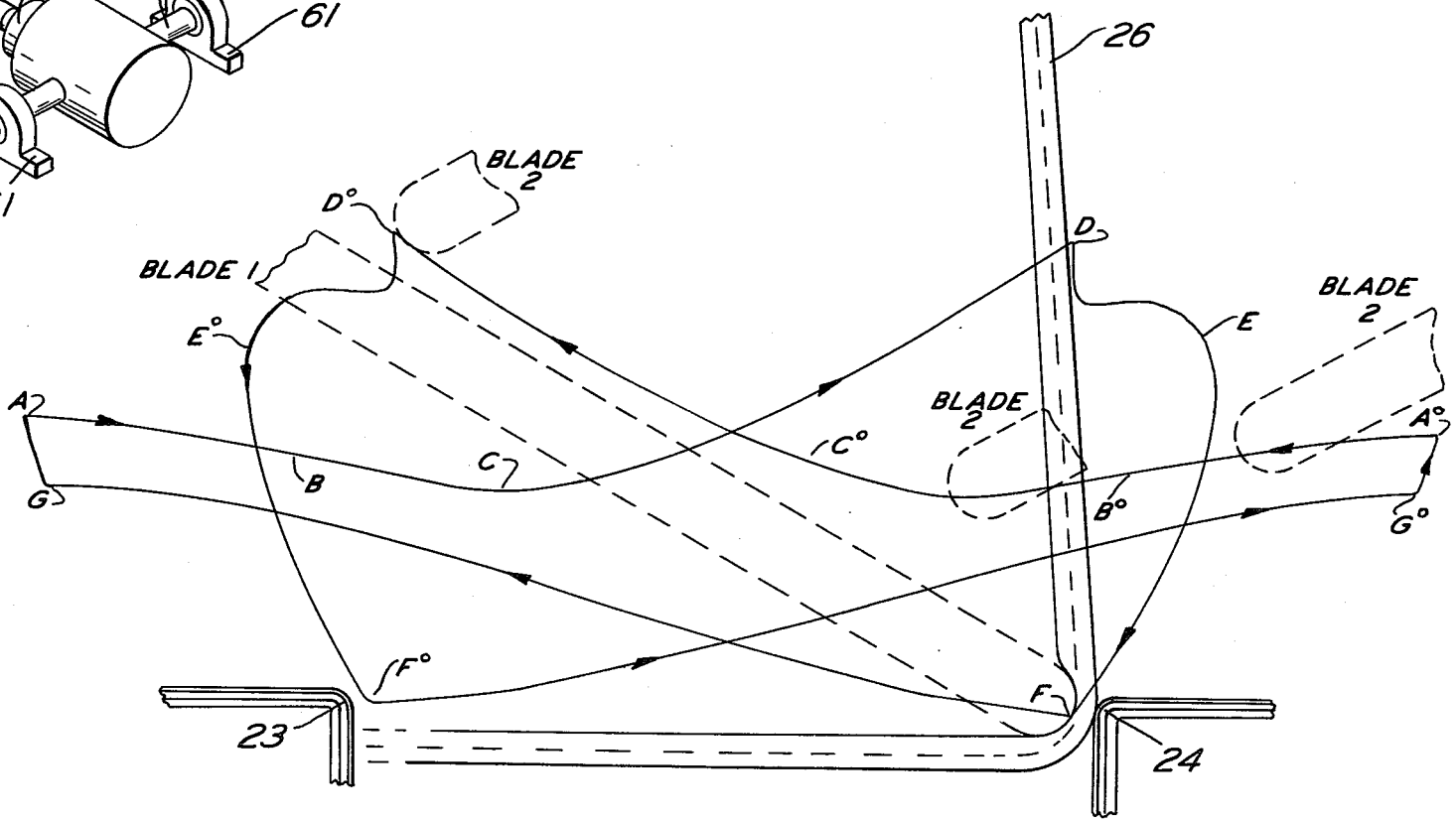

FIG. 1
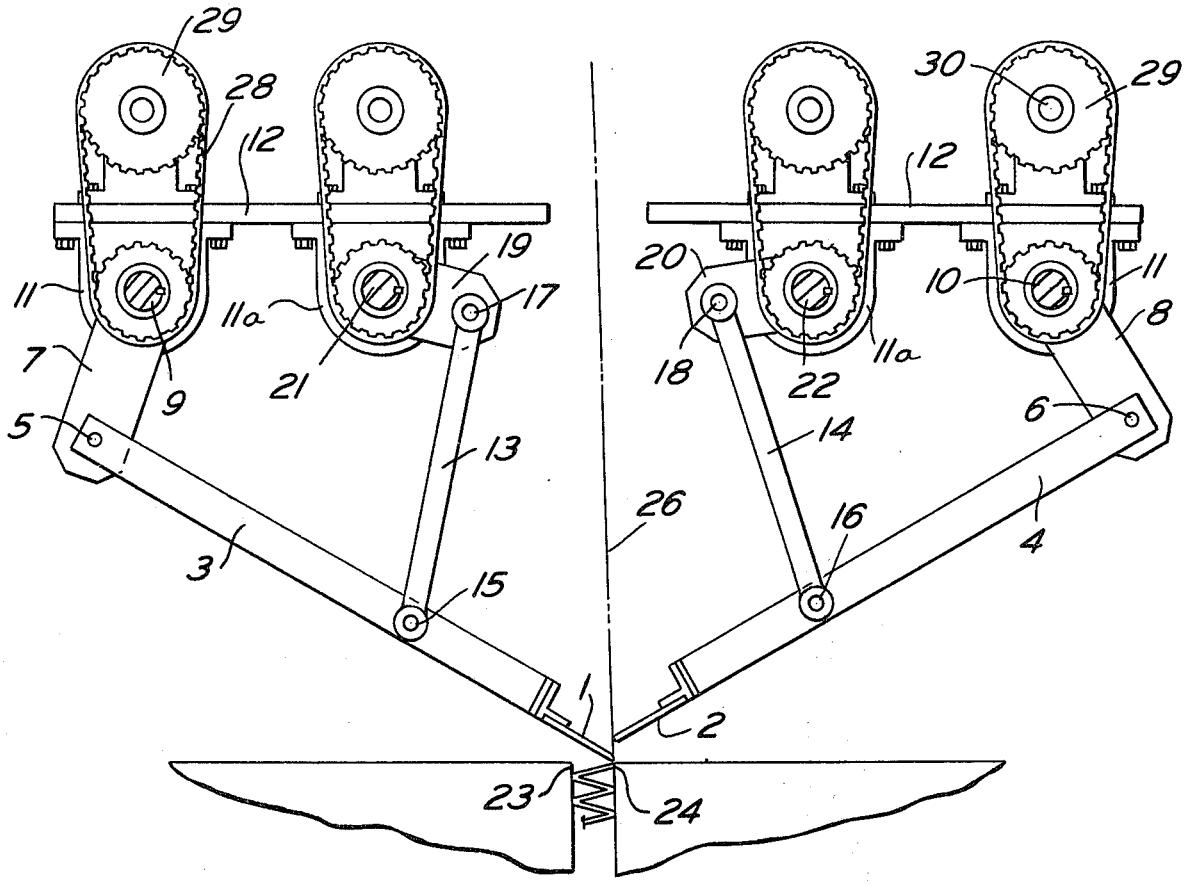
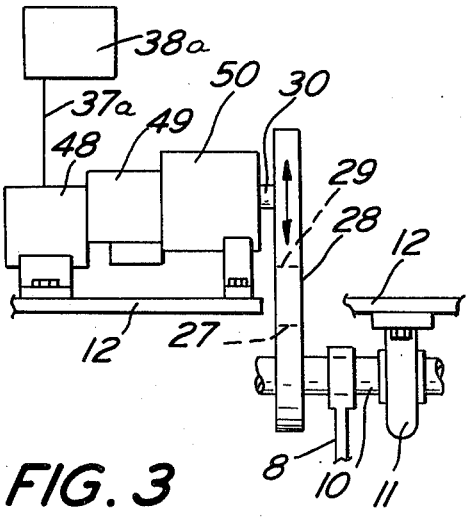
FIG. 3
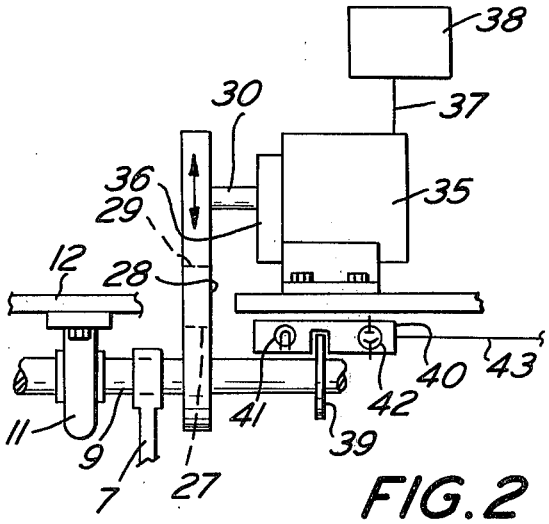
FIG. 2

MACHINE AND METHOD OF OPERATION THEREOF FOR PRODUCING NON-WOVEN "GLUED" CARPETS

DESCRIPTION OF THE INVENTION

Devices have already been provided for the production of "glued" or "bonded" non-woven carpets wherein two separate backing sheets or layers are unrolled from two supply rolls and are fed past adhesive applying stages and after being coated with adhesive, they are fed downwardly through a narrow passage, one of the sheets with its adhesive layer proceeding down one side of the passage with its adhesive-coated side opposed to the adhesive-coated side of the other layer which proceeds down the other side of the passage. Presser blades, bars, or plates extending the full width of the machine alternately move toward one and then the other of the coated layers and in so doing, press the pile-forming fibrous sheet moving downwardly therebetween alternately against the coated layers. Such presser bars may be driven by eccentric devices through suitable guideways (as in various patents, including U.S. Pat. No. 3,010,508) so that one of the bars is retracted while the other comes into play and presses the warp sheet against the opposite adhesive-coated sheet. The result is the production of a zig-zag disposition of the threads or yarns fed into the passage by the warp sheet. Besides the use of eccentric driving of the presser bars along guideways, other systems have been employed such as shown in U.S. Pat. Nos. 3,127,293 and 3,657,052, the latter patent using various levers and cams for imparting a selected path to the presser bar. Thus, in the latter patent, each presser bar is operated by a plurality of pairs of cams actuating a linkage system in each of which one of the opposed presser bars or an extension thereof is a component link.

Figure 4:
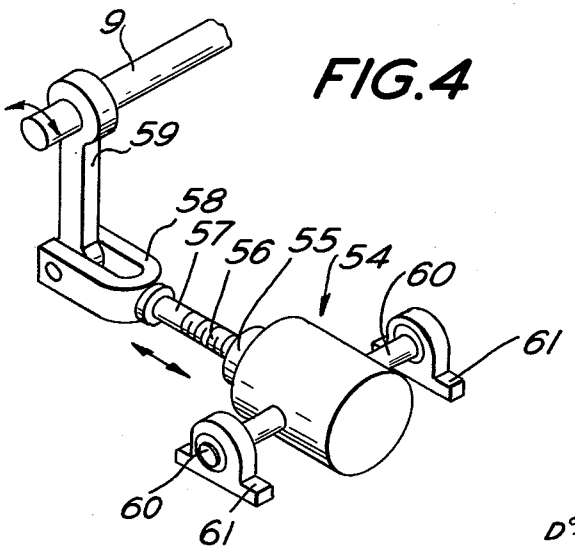

In the drawing, which is illustrative of the invention,

FIG. 1 is an elevation showing a face view of the presser bar mechanism, the carpet-forming passage or well being shown in outline, FIG. 2 is a diagrammatic elevation (taken at right angles to the direction of viewing FIG. 1) of one embodiment of the drive mechanism for oscillating one of the four countershafts, FIG. 3 is a diagrammatic elevation of a modified drive linkage and mechanism for oscillating one of the four countershafts, FIG. 4 is a perspective view showing a modification of a detail, and FIG. 5 is a diagram, on an enlarged scale, of the paths followed by the tips of the two presser plates or bars in one embodiment, as viewed from the side of the machine (FIG. 1).

As viewed in FIG. 1, the pile-forming warp sheet moves downwardly along the dotted line 26 to the top of the passage between the upper edges 23 and 24 of two adjacent supports or tables over each of which an adhesive-coated backing fabric, such as burlap, proceeds to the top entrance of the passage so that its adhesive coating is opposed to that of the other as they enter the passage. Presser bars or plates 1 and 2 extend across the entire width of the machine which may be as narrow as an inch to a foot to produce a narrow pile fabric or as wide as two to twelve feet or even as much as 18 feet or more.

The bars 1 and 2 are secured to suitable frames to provide strength and rigidity to the presser bars lengthwise. Each bar is provided with a supporting linkage, the components of which are movable relative to one another and have articulated or pivoted connections. Thus, the respective bars 1 and 2 are secured to, and project from the frame members 3 and 4 respectively toward the fibrous sheet 26. The members 3 and 4 are in effect levers, each of which is pivotally connected at 5 and 6 to arms 7 and 8 respectively secured to shafts 9 and 10 respectively. These counter shafts are mounted for rotation on their axes in suitable bearings in supports 11 secured to parts 12 of the machine frame. The arms 7 and 8 are fixed to their respective supporting shafts 9 and 10 for oscillation therewith about the axes of the shafts. Links 13 and 14 are pivotally connected at 15 and 16 to the levers 3 and 4 respectively and at their other ends the links 13 and 14, which may be of adjustable length, are pivotally connected at 17 and 18 respectively to arms 19 and 20 respectively. Arms 19 and 20 are secured to shafts 21 and 22 respectively for oscillation therewith about their respective axes. These shafts, like shafts 9 and 10, are mounted in bearing supports 11*a* similar to the supports 11 and secured to frame parts, e.g. 12.

Means for oscillating the several shafts 9, 10, 21, and 22 about their axes is provided and may comprise any one or more of various systems employing, for example, various reversible motors, such as DC electrical motors which are actuated for a given partial revolution or number of revolutions in one or the other direction in response to an electrical pulse or repeatedly in response to a series of such pulses, such as may emanate from a digital computer provided with an appropriate program on tape, wire or the like.

In the embodiment of FIGS. 1 and 2, the shafts 11 and 11a have timing pulleys or sprockets 27 keyed or otherwise secured thereon by which the shafts may be driven, i.e., oscillated about their own axes.

These pulleys or sprockets 27 are driven by timing belts or chains 28 which embrace, and are driven by timing pulleys or sprockets 29 each secured, as by keying or by other suitable means, to a respective drive shaft 30.

Various control systems are employed to oscillate the several shafts 9, 10, 21, and 22. For example, one or more servo-motors or stepping motors may be used for driving (oscillating) each of these shafts in timed relation or sequence to advance one of the presser blades 1 or 2 to a holding position and then retracting or withdrawing it to allow the other blade to be advanced against the other side of the fibrous sheet 26 to its holding position and then retracted. The motions of the two blades are so controlled that they do not clash or interfere with one another during the repeated alternate motions, first of blade 1 into the "pressing and holding" (press-hold) position and then of blade 2 into its pressing and holding position and yet rapid repetition is obtained.

For machines of relatively narrow width, such as those capable of producing a non-woven pile fabric having a width of up to 3 or 4 feet, a single servo-motor per shaft to be oscillated may be sufficient to effectively drive the shaft and since each linkage for one presser bar has two shafts (i.e., 9 and 21 for bar 1 and 10 and 22 for bar 2), such a small machine for making narrow-width fabrics would require only four such servo-motors, one for each of the two shafts in each of the two linkages for the respective bars or blades 1 and 2. When, however, the machine is intended to produce narrow fabrics as well as wider carpets of a width which may be from 4 feet to 12 feet or even larger in width, each of the four shafts to be oscillated are preferably driven by a plurality of such motors spaced at intervals along the shaft to share the load. Of course, each blade is carried by a plurality of frame members 3 (for blade 1) and 4 (for blade 2), each of such members being a part of a plurality of corresponding linkage unit systems, spaced along the length of the associated blade 1 or 2. When a plurality of servomotors are used to drive one of the shafts, they operate in synchronism and are energized by the same signal or sequence of signals. In the following description, whenever it is stated that a servomotor or stepping motor is used to drive one of the shafts, it is to be understood that the statement may embrace the simultaneous or synchronous driving of the shaft by two or more such motors applied at spaced positions along the shaft and receiving the same electrical signals or pulses.

The linkage associated with each blade has two shafts which must be moved in correlation with each other to advance the blade from a retracted position into a press-hold position wherein the blade and its driving elements remain essentially stationary for a predetermined period of time. The servomotor or stepping motor which actuates the shaft 21 or 22 receives electrical signals or pulses in a sequence which is distinct from that applied to the servomotor which actuates the other shaft (9 or 10 respectively) of the pair associated with blade 1 or 2. Similarly, the timed sequence (or logic) of signals applied to the pair of shafts associated with one (linkage and) blade is so correlated with the sequence of signals supplied to the pair of shafts associated with the other (linkage and) blade that while one blade is in press-hold position, the other blade advances from its retracted position to a position in which its leading edge or tip engages the fibrous sheet 26 along its entire width, deflects that sheet over the stationary blade to a position wherein the line of contact of the tip of the upper blade with the fibrous sheet 26 along its width is approximately parallel to, and approximately in vertical alignment above the edge (23 or 24 in FIG. 1) of the passage against which the tip shortly thereafter (after retraction of the first blade to a non-interfering position) presses and holds the sheet 26 against the adhesive-coated backing layer.

Various servo-systems may be used to operate each of the shafts, 9, 10, 21, and 22, the pair 9 and 21 for advancing and retracting blade 1 to and from its press-hold position against edge 24 and then away from it in a manner that does not interfere with the advance and retraction of blade 2 into and out of its press-hold position against the edge 23. To effect the oscillation of shaft 9 as shown in FIG. 2, a reversible permanent-magnet DC motor 35 or stepping motor serves to drive the shaft 30 through a suitable gear reduction unit 36. The timing belt or chain 28 is driven by the timing pulley or sprocket 29 secured to shaft 30 for rotation therewith and belt or chain 28 drives the timing pulley or sprocket 27 secured to shaft 9 for rotation therewith. The motor 35 is energized to rotate in one direction or the other in proper sequence with intervening deenergized interruptions to hold the arm 8 in any particular position for a predetermined interval, such as in the press-hold position hereinabove mentioned. The electrical signals which energize the motor 35 are conducted, as through line 37, from control means, such as a device 38 in which may be any suitable logic device, e.g., a mechanical, electromechanical, or electronic timer or computer (e.g., a digital computer) which is provided with a tape or other patterned control member which is punched, magnetically marked, or otherwise imprinted, with a program to control the number, sequence, duration, and polarity (to control time, extent, and direction of rotation and duration of deenergization, i.e., holding) of electrical pulses or signals.

As shown in FIG. 2, "closed loop" control may be incorporated by providing the shaft 9 with encoding means to detect its angular position at any time and feed it back to the control means, which in that event, comprises means for sensing malfunction and adjusting for it or stopping the machine to prevent damage. Thus, the shaft 9, as shown in FIG. 2, has an indexing collar 39 fixedly secured to the shaft.

A detecting device is located in a stationary position adjacent the path of revolution of the collar and comprises a housing 40 containing a light source 41 and a photosensitive cell 42 for receiving light from the source 41. The collar is suitably perforated axially to transmit light in a controlled manner to the photocell 42 to indicate the angular position of the shaft. The signals from 42 are conducted through line 43 to means for arresting the machine which can be housed in the same housing as the control device 38. As stated previously, when the carpet-making machine is relatively wide, two or more motors 35 and gear reducers 36 may be provided to drive a corresponding number of pulleys or sprockets 27 spaced along the shaft to share the load.

A similar driving system serves to oscillate shaft 21, the logic program being correlated with that used for controlling the signals to the motor(s) on shaft 9 to move the tip or terminus or leading edge of the blade 1 through the predetermined path to advance it from retracted position to the press-hold position against the edge 24, holding for a predetermined period while blade 2 comes into action, advancing from its retracted position (where its leading edge or tip is out of contact with the fibrous sheet 26) and pushing the fibrous sheet 22 to a position above the opposite edge (23) of the entrance to the passage (the top thereof as viewed in FIG. 1) and just above the shank of blade 1 in its press-hold position. At about this point, blade 1 recedes from its press-hold position against the fibrous sheet or web 26, and in receding, blade 1 moves out of the way of the advancing blade 2, allowing the latter to swing down (without interference or clashing between the two moving blades) until the leading edge of blade 2 reaches its press-hold position exerting pressure against sheet 26, the backing sheet, and the edge 23. The action of the blades 1 and 2 therefore constitutes a repeated interfolding of widthwise-extending strips of the continuous fibrous sheet into zig-zag overlapping relationship (as viewed from the side) at the upper entrance of the passage between the opposed adhesive layers of the two backing sheets. To effect this interfolding, the control means for the driving mechanism for each blade comprises a logic system for energizing and deenergizing the servomotors for rotating each shaft (e.g., 9 and 21 for blade 1 and 10 and 22 for blade 2) in correlated sequence to produce the desired motion of each blade by a generally reciprocally intervolved action thereof.

Control means 38 thus comprises a logic system for issuing electrical signals or pulses not only to the driving mechanism, such as motor/reducer 35/36 in a predetermined sequence for rotating the shaft 9 to predetermined extents in predetermined directions and stopping that rotation at predetermined intervals, but it also issues electrical signals or pulses to the driving mechanism for rotating shaft 21 in interrupted oscillatory fashion and correlating the sequence of signals to the motor drives for both shafts 9 and 21 in such a way that they move the leading edge of blade 1 in a predetermined path. In addition, control means 38 issues signals to the servomotors which drive shafts 10 and 22 of the driving mechanism for blade 2, again according to the master control logic sequence or pattern to move or hold blade 2 in a similar predetermined manner to interfold alternate succeeding strips of the advancing sheet 26 between the opposed adhesive layers on the backing sheets as described hereinabove. The interworking or intervolving motions of blades 1 and 2 occur concurrently to the extent that one of the blades holds a transverse line of the sheet 26 against one layer of adhesive while the other blade starts its advance against the other side of sheet 26 to fold it over the preceding strip.

The motors 35 in the embodiment of FIG. 2 may in a specific instance be conventional stepping motors responsive to electrical signals or pulses from a master digital computer to control the oscillatory movements of the four shafts associated with the two blades 1 and 2.

FIG. 3 shows a modified embodiment of driving mechanism for shafts 9, 10, 21, and 22. Each of these shafts are driven by a stepping motor 48 which drives a gear reducer 49 which in turn positions a servo-valve controlling a hydraulic motor (the housing 50 containing the valve and hydraulic motor) which supplies the main power requirements to oscillate each one of the respective shafts, FIG. 3 showing shaft 10 being so connected through elements 27, 28, 29 and 30. As in the other embodiments, a programmed computer 38a controls the sequence of signals (as through lines such as 37a) to each of the electrohydraulic stepping motors (EHSMs) to actuate the shafts 9, 10, 21, and 22 in predetermined timed relation to effect the interfolding by blades 1 and 2. The EHSM system may operate as a closed loop using an encoder as in the embodiment shown in FIG. 2. However, it has the virtue of high accuracy even when operated as an open loop (i.e., without feedback). Details of construction of a suitable EHSM are shown in Hydraulics & Pneumatics, December, 1974, pp. 55–58.

FIG. 4 is a diagrammatic view showing an alternative linkage for converting rotary motion of a servo-motor (e.g., stepping motor) rotating shaft to oscillate a respective shaft 9, 10, 21, or 22 about its axis. In this system, the stepping motor, permanent magnet DC motor, or EHSM 54 rotates an internally threaded section 56 of a nonrotatable rod 57. Rod 57 is fixed to a yoke 58 which is pivotally connected to an arm 59 fixed to a respective one of shafts 9, 10, 21, or 22 so that swinging movement of arm 59 oscillates the shaft, e.g., shaft 9, about its axis. Means is provided for mounting the stepping motor casing pivotally on an axis parallel to the axis of the respective shaft to be oscillated (9 in this instance). For example, the stepping motor casing is provided with trunnions 60 which project into a pair of stationary bearings 61 which allow the stepping motor to pivot as required. Means is provided for preventing nut 55 from moving axially with respect to the motor 54 during rotation of the nut thereby.

In FIG. 5, there is shown a diagrammatic representation of the motions of the leading edges of the blades 1 and 2 in one embodiment, i.e., the paths taken by the blades relative to the advancing fibrous sheet 26 and the corners 23 and 24 of the platens defining the upper entrance of the passage through which the fibrous sheet and the adhesive-coated backing layers proceed downwardly. It is to be understood that the paths shown herein represent one preferred embodiment and as discussed hereinafter, parts of these paths may be shifted if desired. Blade 1 is shown in its press-hold position wherein the tip of the blade is pressed against the platen 24 with the fibrous sheet 26 and the adhesive coated backing fabric between the leading edge of the blade and the platen. It is to be understood that this figure shows a greatly enlarged view of the paths taken by the blades. This press-hold position is represented by the point F on the line A through G representing the path of the centerline of the leading edge of blade 1. The retracted position of the blade is along the line GA and it can be considered that the beginning of the cycle of the motion of blade 1 starts with the leading edge thereof somewhere along the line GA such as at point A itself. In contrast to the path shown for blade 1 starting at A and going in the direction indicated by the arrowheads on the line of the path and ending at A, the path followed by blade 2 is represented by the path from $A^o$ through the presshold position $F^o$ back to $A^o$, the retracted position.

For convenience, the description of the path of the blades may start with the blade 1 having its tip F in the press-hold position opposed to the platen 24. In this position, which holds the sheet 26 against the adhesive layer for a predetermined period of time, blade 2 starts from its initial retracted position $A^o$ and advances therefrom through a point $B^o$ where it approaches the sheet 26, then moves the sheet 26 through $C^o$ where it approaches without touching the stationary blade 1 which is still holding the sheet 26 at the entrance against platen 24. The motion of blade 2 continues to a point $D^o$ where it has, in effect, lapped the fibrous sheet 26 along the upper surface of blade 1 from the tip of that blade back to the portion adjacent the point $D^o$ when blade 1 is in the presshold position. The path of the blade 2 along the upper surface of the stationary blade 1 while it is in press-hold position may be such as to exert a light pressing action against the fibrous sheet between the blade 1 and the leading edge of blade 2. However, on the other hand, the motion of blade 2 may follow a path (from $A^o$ through $B^o$, $C^o$ and $D^o$) which is spaced substantially away from the upper surface of blade 1. When the leading tip of blade 2 reaches a line represented by the point $D^o$, essentially above the corner 23 of the platen, blade 2 may hold the sheet 26 in that position while blade 1 is retracted from its press-hold position F. In the retraction of blade 1, the leading edge follows the arrow of the line from F to G and then A. During such retraction, blade 2 may start to move downwardly from position $D^o$ toward the press-hold position $F^o$. The sequence of action of the two blades during retraction of the blade 1 out of the way of blade 2 after the latter reaches position $D^o$ is such as to move the leading edge of blade 2 downwardly as fast as possible without creating a clashing of the blades as blade 1 retracts and blade 2 moves downwardly. This does not preclude such a motion of blade 2 relative to blade 1 as might press the sheet 26 between the lateral upper surface of blade 1 and the leading edge of blade 2 as the latter blade moves from $D^o$ towards $F^o$. The shape of the path of the blade as it moves from $D^o$ downwardly to the press-hold position $F^o$ may be varied widely, but in the particular preferred embodiment shown, this path includes a bulge through a point $E^o$ as viewed in FIG. 5. If desired, the bulge action may be omitted or diminished in extent as the longitudinal centerline of the leading edge of blade 2 moves from an upper line represented by point $D^o$ down to the press-hold position at $F^o$.

The speeds with which the blades proceed through their paths or portions thereof, as indicated, may vary widely but it is important that the blades 1 and 2 press and hold the fibrous sheet 26 for a definite period of time in each instance while the other blade advances to a position which extends the overlapped layer of fibrous sheet 26 essentially to the greatest extent before retraction of the blade from press-hold position is effected.

The machine described is characterized by outstanding versatility, e.g., that obtained by the ease with which the path of the blades may be changed to accommodate various desired pile heights (in conjunction with appropriate spacing of the passage space between 23 and 24) and the ease with which minor adjustments of the space path may be made to accommodate various diameters and types of natural and man-made fibrous materials or yarns as may be required by their individual characteristics.

While the preceding description describes operation of the machine in such a manner as to produce simultaneously two cut-pile bonded carpets, it can be modified to produce a single looped pile carpet, either by omitting the adhesive on one of the "backing" sheets as it proceeds to the "well" defined by the edges 23 and 24 of the tables in which case this backing sheet may simply be an endless belt or the wall of the well extending down from the edge 23 or 24 of the table; or by using a heat-settable adhesive on one backing and a water-soluble adhesive on the other (e.g., on a moving endless belt) so that the latter adhesive can be washed out after the former adhesive has been set. In either case, the cutting step would be omitted.

It is to be understood that changes and variations may be made without departing from the spirit and scope of the invention as defined in the claims.

I claim:

1. In a machine for making bonded non-woven carpets comprising means for feeding two backing sheets toward one another and over the opposite edges of an entrance to a receiving passage extending widthwise of the sheets across the machine, means for feeding a fibrous sheet through the entrance into the passage, opposed presser blades extending widthwise of the machine, a mechanical linkage connected to each presser blade and having an arm secured to an oscillatable shaft for oscillation therewith, for advancing and withdrawing the blade in timed sequence to alternately press the fibrous sheet against one and then the other of the opposed backing sheets as they pass into the passage entrance, the improvement wherein the means for oscillating the shaft comprises electric motor means having a drive shaft rotatable in either direction in response to an electric signal or pulse, control means for generating and transmitting to the motor means (1) one or more electrical signals or pulses of predetermined polarity and duration to drive the motor shaft in one direction through a predetermined angle and (2) one or more electrical pulses of polarity opposite that of (1) to drive the motor shaft in the opposite direction through a predetermined angle, said control means having logic means for predetermining the sequence of the (1) pulse or pulses and of the (2) pulse or pulses, to oscillate the shaft and actuate the linkage associated therewith to advance and withdraw the respective presser blade in a predetermined manner.

2. A machine according to claim 1 in which the control means comprises a digital computer programmed to transmit electrical signals in timed relation to each oscillatable shaft.

3. A machine according to claim 2 in which the control means actuate the mechanical linkage connected to a respective presser blade in such manner as to move its leading edge or pressing tip repeatedly through a cyclic or closed path designated generally by the line ACDFA in FIG. 5 herein, with an interruption of movement for a predetermined time interval at least in the position F.

4. A machine according to claim 3 in which control means actuate the mechanical linkage connected to the other blade to move its leading edge or tip repeatedly through the cyclic or closed path $A^o$ $C^o$ $D^o$ $F^o$ $A^o$ with an interruption of movement for a predetermined time interval at least in the position $F^o$, the movements of the leading edge of one blade being correlated with respect to the movement of the leading edge of the other to avoid clashing interference of one blade with the other during their movements in their cyclic paths.

5. A machine according to claim 2 wherein the oscillatable shaft drives a sprocket and chain arrangement in which one sprocket is driven by the oscillatable shaft and another sprocket, driven by the first, actuates the mechanical linkage connected to the presser blade.

6. A machine according to claim 2 wherein the control means, and electric motor means form part of a closed-loop system having encoding means for developing an electric signal responsive to the angular position of the electric motor means rotable drive shaft and means for feeding the signal back to the control means for sensing malfunction and adjusting therefor.

7. A machine according to claim 6 wherein the electric motor means is a stepping motor.

8. A machine according to claim 7 wherein the stepping motor is an electrohydraulic stepping motor.

9. A machine according to claim 2 wherein the control means and electric motor means form part of an openloop system in which digital pulse input from the control means directly controls angular position of the electric motor means rotable drive shaft without feedback.

10. A machine according to claim 9 wherein the electric motor means is a pulse motor.

11. A machine according to claim 10, wherein the pulse motor is an electrohydraulic pulse motor.

* * * * *